United States Patent [19]

Wurst et al.

[11] 4,159,685

[45] Jul. 3, 1979

[54] FORMATION OF VARIABLE WIDTH CUTTING SPACE BUTTONHOLE PATTERNS IN AN ELECTRONICALLY CONTROLLED SEWING MACHINE

[75] Inventors: John W. Wurst, Dover; William H. Dunn, Branchville, both of N.J.

[73] Assignee: The Singer Company, New York, N.Y.

[21] Appl. No.: 928,938

[22] Filed: Jul. 28, 1978

[51] Int. Cl.[2] ..... D05B 3/06; D05B 3/02

[52] U.S. Cl. ..... 112/158 B; 112/158 E

[58] Field of Search ..... 112/158 B, 158 E, 158 R, 112/158 A, 121.12, 121.11, 65, 68

[56] References Cited

U.S. PATENT DOCUMENTS

| | | | |
|---|---|---|---|
| 2,862,468 | 12/1958 | Johnson | 112/158 A |
| 3,000,333 | 9/1961 | Moro | 112/158 A |
| 3,060,875 | 10/1962 | Iida | 112/158 B |
| 3,984,745 | 10/1976 | Minalga | 112/158 E X |
| 4,016,821 | 4/1977 | Minalga | 112/158 E |

*Primary Examiner*—Peter Nerbun

*Attorney, Agent, or Firm*—David L. Davis; Robert E. Smith; Edward L. Bell

[57] ABSTRACT

A sewing machine is disclosed wherein the positional coordinates for successive stitch penetrations are stored in a memory having addressable locations corresponding to a plurality of operator selectable patterns, one of which is a buttonhole pattern. The buttonhole pattern includes two parallel rows of zig-zag stitches forming a pair of buttonhole side bars, the inner stitches of the side bars defining a cutting space therebetween and the outer stitches of the side bars defining the width of the buttonhole pattern. Means are provided for operator initiation of an override command to selectively alter the operation of the bight actuator to selectively control the position of only the inner side bar stitches so as to selectively vary the width of the cutting space while maintaining constant the overall buttonhole pattern width.

2 Claims, 6 Drawing Figures

| ENCODED DATA FOR LARGE BUTTONHOLE | | | |
|---|---|---|---|
| STITCH NO. | CODE | FEED INCREMENT(IN.) | BIGHT POSITION(IN.) |
| 1 | 10010011110 | 0.0 | 0.0 |
| 2 | 10010000110 | 0.0 | 0.120 |
| 3 | 00111110110 | 0.017 | -0.120 |
| 4 | 10010000110 | 0.0 | 0.120 |
| 5 | 11101110110 | -0.017 | -0.120 |
| 6 | 10010000110 | 0.0 | 0.120 |
| 7 | 00111110110 | 0.017 | -0.120 |
| 8 | 10010000110 | 0.0 | 0.120 |
| 9 | 00111001100 | 0.017 | 0.090 |
| 10 | 00111010101 | 0.017 | 0.050 |
| 11 | 10010000110 | 0.0 | 0.120 |
| 12 | 11101110110 | -0.017 | -0.120 |
| 13 | 10010000110 | 0.0 | 0.120 |
| 14 | 00111110110 | 0.017 | -0.120 |
| 15 | 10010000110 | 0.0 | 0.120 |
| 16 | 11101110110 | -0.017 | -0.120 |
| 17 | 00111000110 | 0.017 | 0.120 |
| 18 | 11101011010 | -0.017 | 0.020 |
| 19 | 11101000110 | -0.017 | 0.120 |
| 20 | 11101011011 | -0.017 | 0.020 |
| 21 | 11101000110 | -0.017 | 0.120 |
| 22 | 00111110000 | 0.017 | -0.090 |
| 23 | 00111101001 | 0.017 | -0.050 |
| 24 | 11101110110 | -0.017 | -0.120 |
| 25 | 11101100011 | -0.017 | -0.020 |
| 26 | 11101110110 | -0.017 | -0.120 |
| 27 | 10010101110 | 0.0 | -0.080 |
| 28 | 10010110110 | 0.0 | -0.120 |
| 29 | 00000111110 | END OF PATTERN | |

Fig.3

| BUTTONHOLE BIGHT OVERRIDE DUTY CYCLE CODE TABLE | | |
|---|---|---|
| OVERRIDE DIGIT DISPLAYED | STORED CODE | PERCENT OF FULL WIDTH |
| 9 | 00000 | 3.1 |
| 8 | 00100 | 15.6 |
| 7 | 01000 | 28.1 |
| 6 | 01100 | 40.6 |
| 5 | 01111 | 50.0 |
| 4 | 10011 | 62.5 |
| 3 | 10110 | 71.9 |
| 2 | 11001 | 81.3 |
| 1 | 11100 | 90.6 |
| 0 | 11111 | 100.0 |

FORMATION OF VARIABLE WIDTH CUTTING SPACE BUTTONHOLE PATTERNS IN AN ELECTRONICALLY CONTROLLED SEWING MACHINE

BACKGROUND OF THE INVENTION

This invention relates to sewing machines and, more particularly, to sewing machines having positional coordinates for successive stitch penetrations stored in a memory. Specifically, this invention relates to the alteration of such positional coordinates, under operator command, during the formation of a buttonhole pattern so as to selectively vary the width of the buttonhole pattern cutting space while maintaining constant the overall buttonhole pattern width.

A sewing machine is disclosed in copending U.S. patent application Ser. No. 928,940, filed on even date herewith by the applicants herein, and assigned to the assignee of the present invention, wherein the positional coordinates for successive stitch penetrations are stored in a memory having addressable locations corresponding to a plurality of operator selectable patterns. Means are provided for operator initiation of an override command to selectively alter the operation of the feed and bight actuators to an amount of motion different from that dictated by the stored pattern information. An operator influenced control provides a digital signal corresponding to a desired alteration value. Override memory locations are provided for storing bight and feed actuator motion alteration values. These locations are addressed in accordance with the selected pattern and the digital override signal provided by the operator. The alteration values are utilized for control of the appropriate feed and bight actuators. One of the operator selectable patterns is a buttonhole pattern. In many instances, it is desirable to vary the buttonhole pattern cutting space while maintaining constant the overall buttonhole pattern width. Such is not possible with the arrangement disclosed in the aforereferenced application because in the system disclosed therein the alteration values are applied to every stitch within a selected pattern.

It is therefore an object of the present invention to provide a sewing machine having buttonhole pattern sewing capability wherein the width of the cutting space may be selectively varied while maintaining constant the overall buttonhole pattern width.

SUMMARY OF THE INVENTION

The foregoing and additional objects are attained in accordance with the principles of this invention in a sewing machine having stitch forming instrumentalities positionally controlled over a predetermined range between stitches to produce a pattern of feed and bight controlled stitches, static memory means for storing pattern stitch information, means operating in timed relation with the sewing machine for recovering selected pattern stitch information from the static memory means, separate actuating means responsive to the pattern stitch information for influencing the feed and bight motions respectively to produce a pattern of stitches corresponding to the selected pattern stitch information, and controllable bight alteration means effective to alter the operation of the bight actuating means to an amount of motion different from that dictated by the pattern stitch information, wherein a buttonhole pattern includes two parallel rows of zig-zag stitches forming a pair of buttonhole side bars, the inner stitches of the side bars defining a cutting space therebetween and the outer stitches of the side bars defining the width of the buttonhole pattern, by providing means for selectively varying the width of the cutting space while maintaining constant the overall buttonhole pattern width including override memory means for storing bight actuating means motion ateration values in addressable memory locations, operator controlled means for providing an address signal corresponding to a desired alteration value, means utilizing the address signal for retrieving from the override memory means the desired alteration value, and converting means operative only during the inner stitches of the side bars for converting the desired alteration value into a control signal for rendering effective the bight alteration means.

BRIEF DESCRIPTION OF THE DRAWINGS

The foregoing will be more readily apparent upon reading the following description in conjuction with the drawing in which:

FIG. 3 is a table of encoded data for producing a buttonhole pattern of the type to which the principles of this invention may be applied;

DETAILED DESCRIPTION

Figure 1:
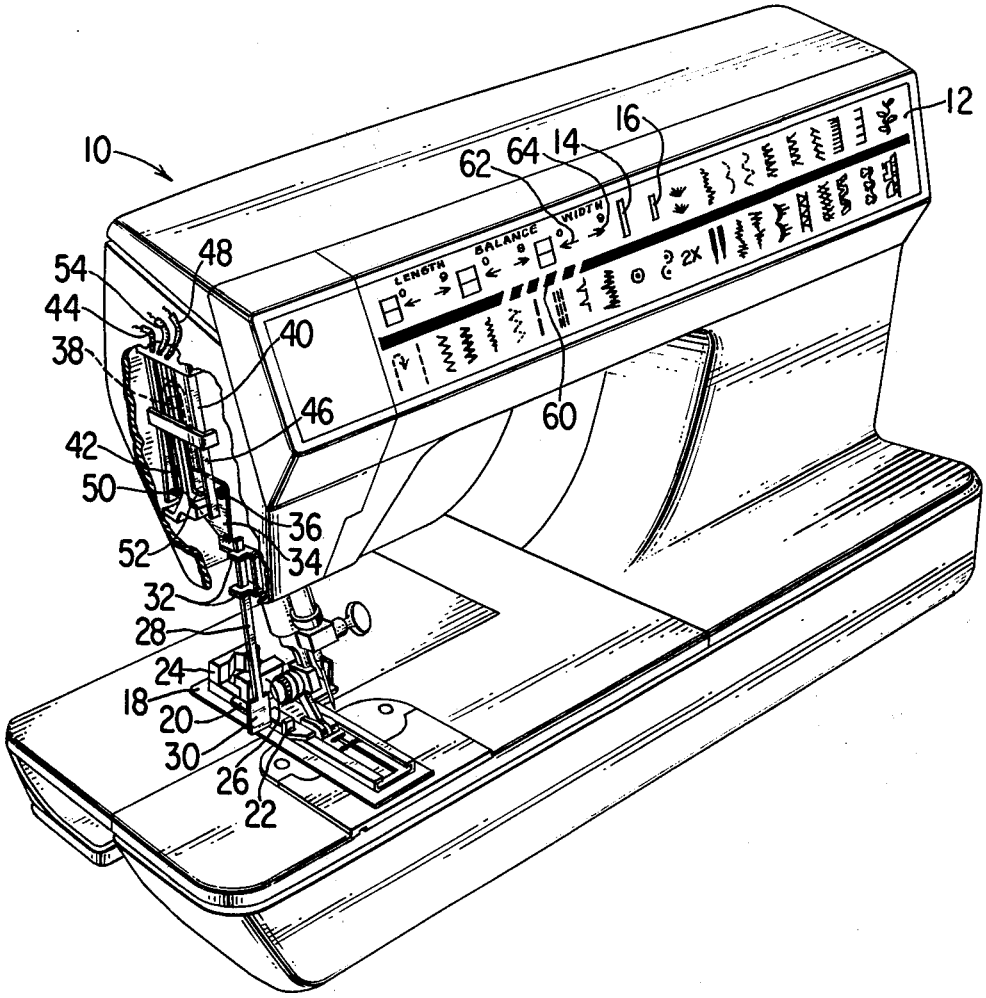
FIG. 1 is a perspective view of a sewing machine in which an arrangement constructed in accordance with the principles of this invention may be incorporated.

Referring to the drawings, FIG. 1 illustrates a sewing machine indicated generally at 10 having a control panel 12 illustratively of the type utilizing a continuous planar element such as a glass panel to which circuitry is applied as by deposition or the like to provide controls sensitive to the touch of an operator's finger. Indicated on the control panel 12 are touch sensitive areas having respective representations of various stitch patterns which may be automatically sewn by the sewing machine 10. For an understanding of the manner in which automatic pattern sewing may be accomplished, the reader is referred to U.S. Pat. No. 3,872,808, issued to John W. Wurst on Mar. 25, 1975, the disclosure of which is hereby incorporated by reference.

Further, the control panel 12 has thereon areas which may be touched by an operator to override the stored values for controlling stitch length and width. For an understanding of the manner in which such override control may be implemented, the reader is referred to the aforereferenced copending U.S. patent application, the disclosure of which is hereby incorporated by reference.

The subject invention is concerned with the sewing of a buttonhole pattern. The sewing machine 10 is provided with the capability of sewing either a large buttonhole, indicated by the large buttonhole representation 14 on the control panel 12, or a small buttonhole, indicated by the small buttonhole representation 16 on the control panel 12. When a buttonhole pattern is to be sewn, a buttonhole presser foot 18 is installed on the sewing machine 10. The buttonhole presser foot 18 is of the type described in U.S. Pat. No. 3,877,403, which issued to Stanley J. Ketterer on Apr. 15, 1975. The buttonhole presser foot 18 includes a fixed rear stop member 20 and an adjustable front stop member 22, the distance therebetween defining the length of the buttonhole pattern being sewn, as determined by the size of button inserted between an anchor element 24 and a button gauging element 26. The sewing machine 10 further includes a switch mechanism including a lever arm 28 terminating in a paddle 30 at its lower end. The other end of the lever arm 28 is received by openings in a pair of spaced lugs 32 formed at one end of a lever 34. The lever arm 28 may therefore be selectively raised and lowered by an operator, the operator lowering the lever arm 28 so that the paddle 30 is intermediate the stops 20 and 22 during the formation of a buttonhole pattern.

The lever 34 is pivoted at 36 and at the end opposite the lugs 32 has a pin 38 mounted thereon for cooperation with an electrical switch member 40. The switch member 40 includes a first fixed contact 42 connected to a wire 44, a second fixed contact 46 connected to a wire 48, a first moveable contact 50 and a second movable contact 52, the first and second moveable contacts 50 and 52 being connected to a wire 54. The pin 38 mounted on the lever 34 is intermediate the moveable contacts 50 and 52. When the buttonhole presser foot 18 is positioned for needle penetrations at a first end of a buttonhole pattern, the paddle 30 is in contact with the stop 20 and is pushed forward so that lever 34 pivots about pivot point 36 and causes pin 38 to push moveable contact 50 against fixed contact 42. At the other end of the buttonhole pattern, the buttonhole presser foot 18 is moved rearward so that the stop 22 moves the paddle 30 back which causes the lever 34 to pivot about pivot point 36, causing pin 38 to push moveable contact 52 against fixed contact 46. The significance of this action will become apparent from the description which follows.

Figure 2A:
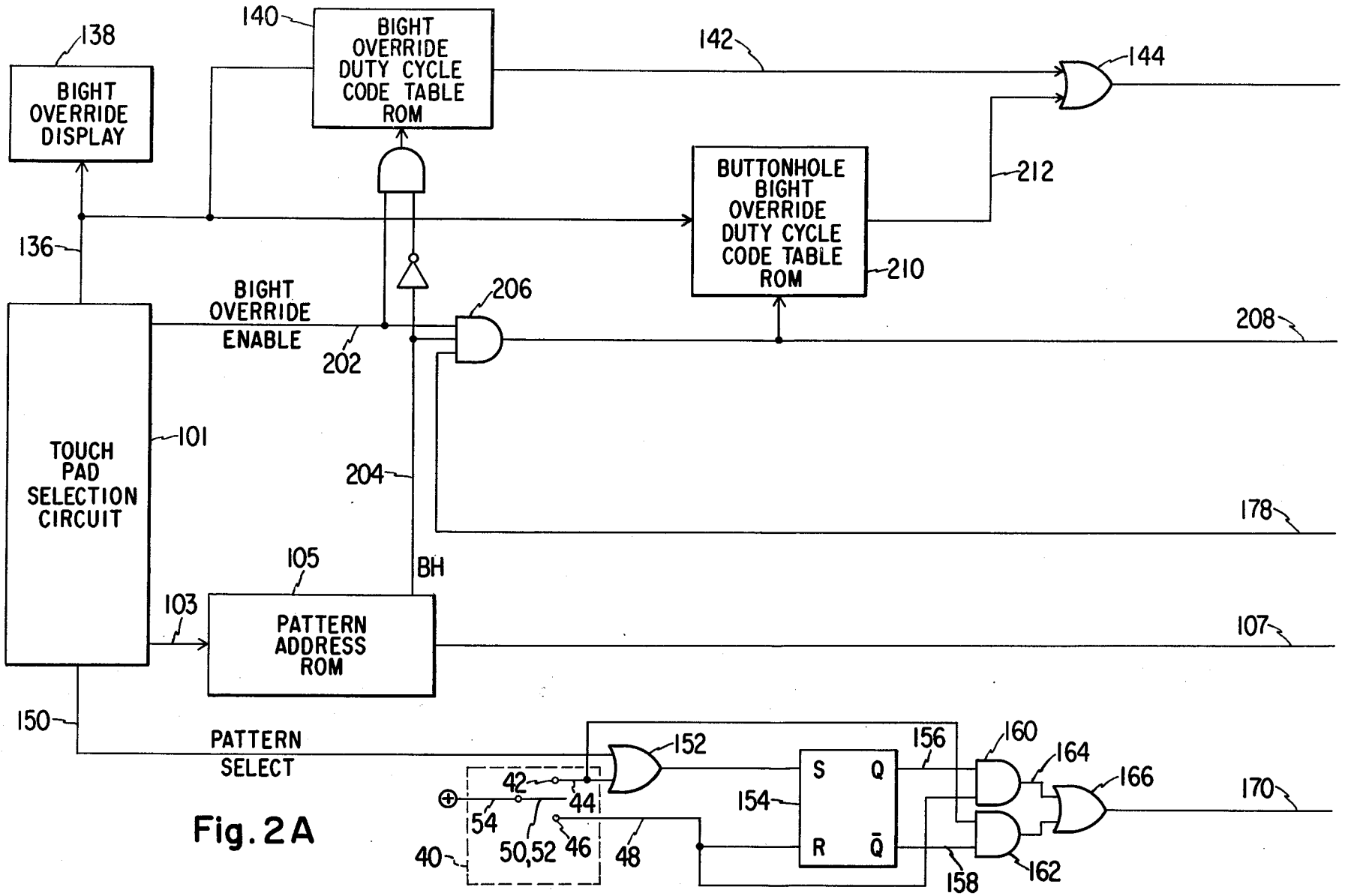
FIGS. 2A and 2B, with FIG. 2A placed to the left of FIG. 2B, together form a block schematic diagram of illustrative circuitry constructed in accordance with the principles of this invention.
Figure 2B:
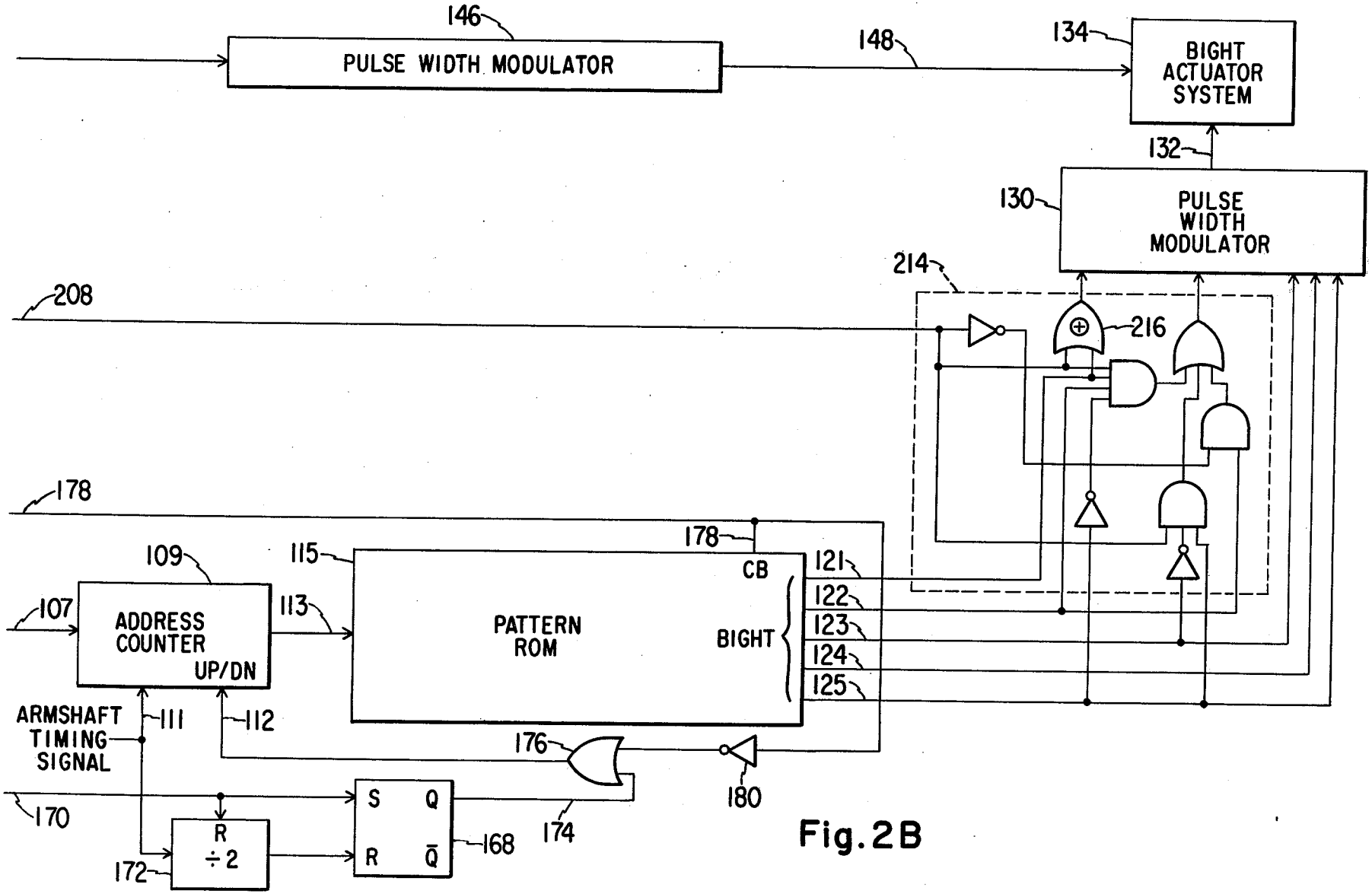

Referring now to FIGS. 2A and 2B, the circuitry shown therein is a portion of the total circuitry which is responsive to an operator's finger touching selected areas of the control panel 12 for controlling the operation of the sewing machine 10 to form stitches in a selected pattern in accordance with information stored in a memory. In particular, the circuitry shown in FIGS. 2A and 2B is that portion of the circuitry for controlling the stitch width in accordance with desired operator initiated override functions. For a complete explanation of the operation of the stitch width and length override control circuitry, the reader is referred to the aforereferenced copending U.S. patent application. Those portions of the circuitry of FIGS. 2A and 2B which are described in full detail in that application will be described herein only in as much detail as is necessary for an understanding of the present invention.

The touch of a selected pattern area, such as the pattern area 14 (FIG. 1) for the large buttonhole pattern, causes an appropriate pattern selector code word to be provided by the touch pad selection circuit 101 on the leads 103 to the pattern address ROM 105. The pattern address ROM 105 provides over the leads 107 to the address counter 109 a code word representing the selected pattern. This code word on the leads 107 determines the starting point of the address counter 109 which has a count input line 111 upon which are provided pulses from the arm shaft pulse generator (not shown). Additionally, the address counter 109 has an input lead 112 for selectively controlling the address counter to count either up or down (i.e.; increment or decrement) depending upon whether the signal applied to the lead 112 is high or low, respectively. The address counter 109 has output leads 113 which are connected to the inputs of a pattern ROM 115. Although a counter 109 has been shown, it is apparent that any other sequence generator may be utilized so long as the sequence generator may be initialized to some point in its sequence by the code applied thereto over the leads 107, and thereafter generates a predetermined sequence of output codes over the leads 113 in response to input pulses on the lead 111. Such a sequence generator may be, for example, a shift register with hard wired feedback, as is known in the art.

The pattern ROM 115 has output lines 121, 122, 123, 124 and 125 upon which are provided a digital code word for the bight actuator system. The bight actuator system is adapted to convert a digital code word from the pattern ROM 115 into a mechanical position which locates the sewing machine needle in a conventional stitch forming instrumentality. Additionally, although not shown in the drawing because it does not form any part of the present invention, the pattern ROM 115 has output lines which provide a digital code word for the feed actuator system, which is similar in construction to the bight actuator system and is adapted to convert a digital code word from the pattern ROM 115 into a mechanical position which provides a specific work feed for each needle penetration.

As is fully described in the aforereferenced copending U.S. patent application, the digital bight code signals on the leads 121–125 from the pattern ROM 115 are presented as inputs to a pulse width modulator 130. The output of the pulse width modulator 130 on the lead 132 is a high frequency digital signal having an ON/OFF duty cycle controlled by the binary number of the input to the pulse width modulator 130, in a manner well known in the art. The duty cycle controlled signal on the lead 132 is presented as an input to the bight actuator system 134. As fully described in the aforereferenced copending U.S. Patent application, when the operator desires to change the pattern width from that stored in the pattern ROM 115, the width override function is initiated by the operator first touching the override enable area 60 on the control panel 12 and then touching one of the width arrows 62 or 64 (FIG. 1). Upon the occurrence of these events, the touch pad selection circuit 101 provides a BCD signal on the leads 136 to the bight override display 138 and to the bight override duty cycle code table ROM 140. The selected reduction code from the bight override duty cycle code table ROM 140 is then applied over the leads 142 through the OR gate 144 as an input to a pulse width modulator 146 which provides a pulse width modulated duty cycle controlled signal on its output lead 148 to the bight actuator system 134, which functions to reduce the stitch width.

Figures 4, 5:
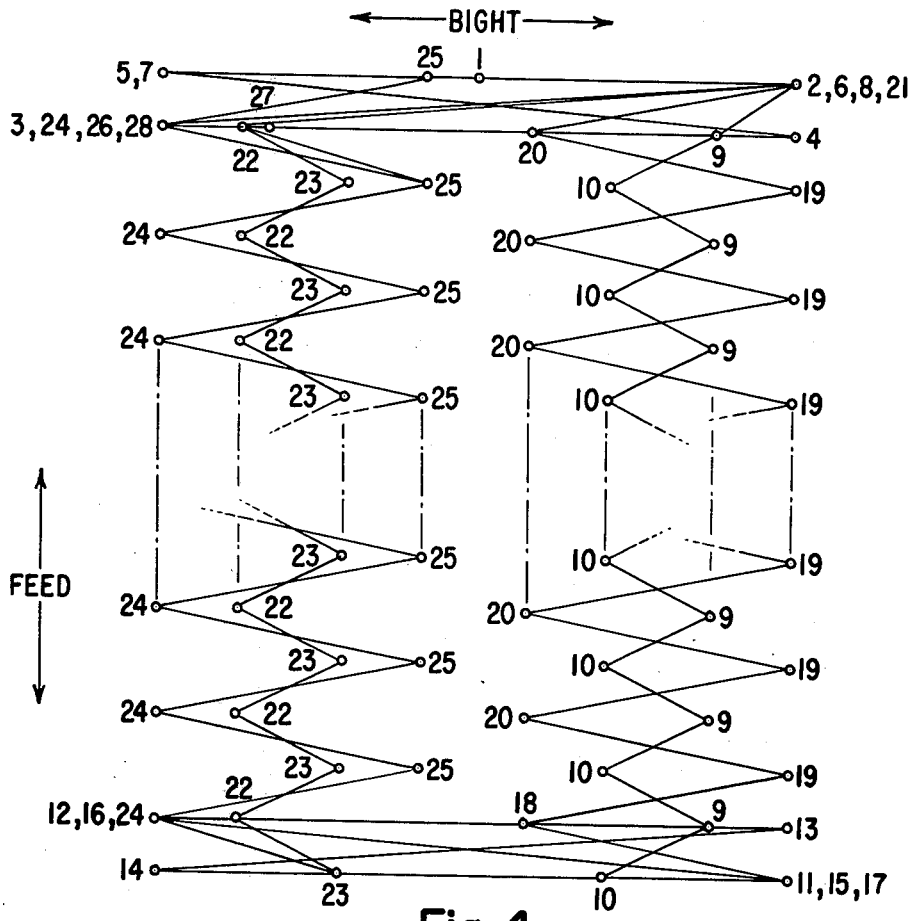
FIG. 4 is a representation of the buttonhole pattern formed from the data illustrated in FIG. 3.
FIG. 5 shows an illustrative buttonhole bight override duty cycle code table stored in memory showing the stored digital code and the percentage of full width for the different override digits, which table may be utilized with the circuitry of FIGS. 2A and 2B.

Since the present invention is concerned with the formation of a buttonhole pattern, a description of the formation of a buttonhole pattern is in order at this time. Referring to FIG. 3, shown therein is encoded data for the formation of a large buttonhole pattern, such data being stored in the pattern ROM 115. FIG. 4 is a representation of the large buttonhole pattern formed from the data illustrated in FIG. 3. The code stored in the pattern ROM 115 comprises an 11 bit digital word for each stitch, as shown in the second column of FIG. 3. In each of these digital words, the 5 leftmost bits correspond to the feed increment; the next 5 bits correspond to the bight position, and the 11th bit is a control bit, the purpose of which will be described in full detail hereinafter.

Referring to FIG. 4, each lateral bight actuated position and corresponding incremental feed displacement in the large buttonhole pattern coded as shown in FIG. 3 is represented by a small open circle, with the stitch number closely adjacent thereto. (The pattern of needle penetrations is actually the mirror image, about a vertical axis, of the pattern shown in FIG. 4.) It is seen that the buttonhole pattern is formed in the following manner. The first 8 stitches form the upper bar. Stitches 9 and 10 form the right side narrow cording stitches for the right side bar. Stitches 11–18 form the lower bar. Stitches 19 and 20 form the visible overlay stitches for the right side bar. Stitch number 21 finishes the right side bar. Stitches 22 and 23 form the narrow cording stitches for the left side bar. Stitches 24 and 25 form the visible overlay stitches for the left side bar. Finally, stitches 26–28 form the tying stitches for the buttonhole pattern. It is noted that the visible overlay stitches for both the left and right side bars are sewn in the same direction. Thus, control of the feed balance is not necessary to provide for the formation of a uniform and consistent buttonhole pattern. It is further noted that the 11th bit of the code word, designated the "control bit" is a ONE in only four stitches. As will be described hereinafter, when the control bit is a ONE this causes the address counter 109 to count down rather than up and therefore to address the previous word again. In this way, a side bar of infinite length may be sewn from only two ROM words which form a "loop", the exit from which is controlled by operation of the switch member 40 (FIG. 1) at both ends of the buttonhole pattern.

The formation of the aforedescribed loop and the function of the switch member 40 will now be described with reference to FIGS. 2A and 2B. When a new pattern is selected, a signal is applied to the lead 150 from the touch pad selection circuit 101. This signal is transmitted to the OR gate 152 to set the flip-flop 154. With the flip-flop 154 set, there is a high signal on the Q output on the lead 156 and a low signal on the $\overline{Q}$ output on the lead 158. This condition enables the AND gate 160 and disables the AND gate 162. Thus, multiple closures of the switch member 40 on the first side (contacts 42 and 50) are ignored. The buttonhole foot 18 and the switch member 40 are so mounted that at the end of stitching of the first side bar, the second contact (contacts 46 and 52) will close. The AND gate 160 will then transmit a short pulse over the lead 164 until disenabled by the resetting of the flipflop 154, which simultaneously enables the AND gate 162. Now multiple contacts on the second side of the switch member 40 will be ignored. This circuitry thus achieves three functions:

1. It debounces the mechanical switch member 40;
2. Only closures on alternate sides of the switch member 40 are recognized; and
3. It generates a short setting pulse through the OR gate 166 for the flip-flop 168.

In this way a single pulse is developed on the line 170 each time the buttonhole foot 18 reaches the end of its travel.

The flip-flop 168 and the divide by two circuit 172 are interconnected such that the output of the flip-flop 168 on the lead 174 remains high for two stitches following a recognized closure of the switch member 40. During these two stitches the high signal on the lead 172 is transmitted through the OR gate 176 to insure a high signal on the lead 112 which controls the address counter 109 to increment. This stitch interval insures that the looping instruction, previously described, is ignored by the address counter 109 until two stitches after a recognized switch closure. The looping instruction is implemented by having the control bit outputted from the pattern ROM 115 over the lead 178. This control bit on the lead 178 is inverted by the inverter 180 and transmitted through the OR gate 176 to the up/down input lead 112 of the address counter 109. Thus, with the flip-flop 168 reset, the control bit signal on the lead 178 controls the direction of counting of the counter 109, a ONE value of the control bit causing the counter 109 to decrement and a ZERO value of the control bit causing the counter 109 to increment. As previously mentioned, for the buttonhole pattern coding shown in FIG. 3, only four stitches have a control bit value of ONE so that only these four stitches cause looping. Closure of the switch member 40 at the end of a buttonhole pattern causes the flip-flop 168 to set, eliminating control of the counter 109 from the value of the control bit, thereby causing the loop to be exited.

Referring now to FIG. 4, shown therein is a representation of a buttonhole pattern sewn in accordance with the encoded data of FIG. 3. In FIG. 4, lateral bight actuator position corresponding incremental feed displacements are indicated by open circles having closely adjacent thereto the corresponding stitch number(s) from the leftmost column of FIG. 3. In the buttonhole pattern shown in FIG. 4, the overall width of the buttonhole pattern is the distance between the leftmost stitches and the rightmost stitches, such as between stitches 24 and 19. The buttonhole cutting space is defined as the region intermediate the innermost stitches, that is between stitches 20 and 25. It is noted from an examination of the encoded data shown in FIG. 3 that the only stitches in the buttonhole pattern wherein the control bit is a ONE are the stitch numbers 10, 20, 23, and 25. Stitches 20 and 25 are the innermost stitches of the overlay stitches and define the cutting space and stitches 10 and 23 are the innermost stitches of the cording stitches. This fact is taken advantage of in accordance with the principles of this invention for providing simplified circuitry for the function of varying the cutting space width.

Returning now to FIGS. 2A and 2B, in accordance with the principles of this invention, when the sewing machine operator is sewing a buttonhole pattern and desires to change the width of the buttonhole cutting space from the width as determined by the stored stitch pattern information, the sewing machine bight override function is enabled in the manner taught by the aforereferenced copending U.S. patent application. A bight override enable signal is applied to the lead 202 by the touch pad selection circuit 101. From the pattern address ROM 105, a signal is applied to the lead 204 indicating that a buttonhole pattern is being sewn. It will be recalled that in order to vary the cutting space width, only the inner stitches are changed and that these stitches are the only ones wherein the control bit is a ONE. The control bit is applied to the lead 178 from the pattern ROM 115. Therefore, the output of the AND gate 206 on the lead 208 will be a ONE only upon the concurrence of three conditions: the bight override function has been initiated by the operator; a buttonhole pattern is being sewn; and the control bit is a ONE.

The presence of a ONE on the buttonhole bight override enable lead 208 causes two action things to occur. First, the buttonhole bight override duty cycle code table ROM 210 is addressed in accordance with the BCD data on the lead 136 to provide override information over the leads 212 and through the OR gate 144 to the pulse width modulator 146, in a manner as disclosed in the aforereferenced copending U.S. patent application. The contents of the buttonhole bight override duty cycle code table ROM 210 are set forth in the table of FIG. 5. It is seen from this table that with an override digit of zero displayed, the full width of stitch is maintained whereas with an override digit of 9 displayed, a minimum width of stitch is effected. Since the width of the stitch is measured from the center needle position, which is the center of the buttonhole pattern (FIG. 4), a maximum width of stitch corresponds to maximum cutting space and a minimum stitch width corresponds to minimum cutting space. Thus, a display of 9 corresponds to maximum side bar width (minimum cutting space) while a display of zero corresponds to minimum side bar width (maximum cutting space).

In order to permit the operator to increase as well as decrease the buttonhole cutting space, the second action to occur when there is a ONE signal applied to the buttonhole bight override enable lead 208 is to "force" the bight code obtained from the pattern ROM 115 to an increased value one increment further from center than the stored value. This is accomplished by the circuitry 214 shown in dashed lines. In order to implement this function in a reasonable manner, in a preferred embodiment the inner side bar codes are restricted to the values 10, 11, 13, 17, 18, and 20. These values are then forced to 9, 10, 12, 18, 19, and 21, respectively, by the circuitry 214. The bight code on the leads 121–125 has its least significant bit position being lead 121 and its most significant bit position being lead 125. Thus, with a ONE on the lead 208, the circuitry 214 functions to invert, through the EXCLUSIVE OR gate 216, the signal on the lead 121 and to change the signal on the lead 122 in accordance with the following logic equation, where (N) is the binary value, ONE or ZERO, of the signal on the lead having the reference numeral N and ($\overline{N}$) is the inverse of such signal:

$$(122)_{new}=(125)\,(\overline{123})+(\overline{125})\,(121)\,(122)_{old}$$

When there is a ZERO on the lead 208, the bight code on the leads 121–125 are transmitted unchanged to the pulse width modulator 130.

Accordingly, there has been disclosed an arrangement for altering, under operator command, the width of the cutting space of a buttonhole pattern sewn by a sewing machine equipped with a memory for storing positional coordinates for successive stitch penetrations of such a pattern. It is understood that the above-described arrangement is merely illustrative of the application of the principles of this invention. Numerous other arrangements may be devised by those skilled in the art without departing from the spirit and scope of this invention, as defined by the appended claims. For example, the principles of this invention may be applied to form a zig-zag stitch which shrinks from half width to full left needle, by "forcing" the center needle code to full left needle and then overriding this code.

Having thus set forth the nature of the invention, what is claimed herein is:

1. In a sewing machine having stitch forming instrumentalities positionally controlled over a predetermined range between stitches to produce a pattern of feed and bight controlled stitches, static memory means for storing pattern stitch information, means operating in timed relation with said sewing machine for recovering selected pattern stitch information from said static memory means, separate actuating means responsive to said pattern stitch information for influencing the feed and bight motions respectively to produce a pattern of stitches corresponding to the selected pattern stitch information and controllable bight alteration means effective to alter the operation of said bight actuating means to an amount of motion different from that dictated by said pattern stitch information, wherein a buttonhole pattern includes two parallel rows of zig-zag stitches forming a pair of buttonhole side bars, the inner stitches of said side bars defining a cutting space therebetween and the outer stitches of said side bars defining the width of said buttonhole pattern, the improvement comprising means for selectively varying the width of the cutting space while maintaining constant the overall buttonhole pattern width including:

override memory means for storing bight actuating means motion alteration values in addressable memory locations;

operator controlled means for providing an address signal corresponding to a desired alteration value;

means utilizing said address signal for retrieving from said override memory means said desired alteration value; and converting means operative only during the inner stitches of said side bars for converting said desired alteration value into a control signal for rendering effective said bight alteration means.

2. In a sewing machine according to claim 1 wherein the bight alteration means includes means for reducing the motion of said bight actuating means, the improvement further including means responsive to an operator initiated request for buttonhole cutting space variation for changing the pattern stitch information for the inner stitches of said side bars by a fixed amount to move said inner stitches a fixed increment away from the center of the buttonhole pattern, whereby a wider cutting space is forced.

* * * * *